US005172967A

United States Patent [19]

Pipe

[11] Patent Number: 5,172,967

[45] Date of Patent: Dec. 22, 1992

[54] ELECTRO-MECHANICAL LOCKING SYSTEM

[75] Inventor: Gregory Pipe, Fruitport, Mich.

[73] Assignee: Meridian Incorporated, Spring Lake, Mich.

[21] Appl. No.: 749,113

[22] Filed: Aug. 23, 1991

[51] Int. Cl.[5] ..... A47B 88/00

[52] U.S. Cl. ..... 312/217

[58] Field of Search ..... 70/279, 282; 312/216, 312/217, 221

[56] References Cited

U.S. PATENT DOCUMENTS

| | | | |
|---|---|---|---|
| 3,831,408 | 8/1974 | Featherman | 70/264 X |
| 4,656,852 | 4/1987 | Deschamps | 70/279 X |
| 4,665,727 | 5/1987 | Uyeda | 70/279 |
| 4,772,078 | 9/1988 | Bowyer | 312/221 |

*Primary Examiner*—Joseph Falk

*Attorney, Agent, or Firm*—Reising, Ethington, Barnard, Perry & Milton

[57] ABSTRACT

A file storage apparatus (10) has a string or stack of drawer elements (14) vertically disposed along a side. A mechanical blocking shaft (28) is disposed on one side of the drawer (14) to allow only one drawer to be opened while blocking the remaining drawers preventing opening. A locking bar (62) is disposed on a second side of the drawers (14) for locking all of the drawers closed in response to an electrical access circuit (72) and for unlocking all of the storage units (14). An actuator member (72) interacts between the access circuit (72) and the locking bar (62) for moving the locking bar (62) between an unlocked and locked position.

21 Claims, 8 Drawing Sheets

ELECTRO-MECHANICAL LOCKING SYSTEM

TECHNICAL FIELD

The subject invention relates to lateral and vertical file storage cabinet having vertically stacked drawers, and more particularly to an interlocking assembly for allowing the withdrawal of only one drawer at a time in combination with locking all of the drawers.

BACKGROUND OF THE INVENTION

File storage cabinets are used for filing documents and are generally of the vertical and lateral type. Such file cabinets usually include a number of file drawers vertically stacked with each file cabinet being moveable from within the cabinet housing to an extended open position to provide access to the drawer space.

If more than one drawer is moved to the open position at the same time, the file cabinet assembly has tendency to tip forward in the opening direction of the drawers. In other words, the center of gravity of the cabinet is shifted sufficiently forward that the entire assembly becomes unstable and can dangerously fall forward.

Many mechanisms have been developed to overcome this tipping problem by preventing more than one drawer from being opened at a time. U.S. Pat. No. 4,772,028, issued Sep. 20, 1988 in the name of Steven M. Boyer, and assigned to the assignee of the subject invention, discloses a drawer interlocking means for storage cabinets. Such a storage unit includes a vertical member extending on a first side of the storage units for locking all of the storage units at a time and opening the same. Included on a second side of the storage units is a blocking member which prevents opening movement from the closed position of all but one of the storage units. A mechanical key element unlocks the locking member allowing access to the storage units and opening of one storage unit when unlocked.

It is desirable to utilize an electronic storage interlocking system rather than a single key. Electronic opening assemblies have been known in single door opening systems wherein electronics codes may be applied to allow unlatching of a door. Such systems are disclosed in U.S. Pat. No. 4,083,424 to von den Stemmen et al, and U.S. Pat. No. 3,812,403 to Gartner, and U.S. Pat. No. 3,831,408 to Featherman, and PCT application PCT/AU87/00014 in the name of Blake.

SUMMARY OF THE INVENTION

The invention includes a storage assembly comprising housing means defining an enclosure and a plurality of storage units to be supported by the housing means for moving between a closed position and an open position. Blocking means are disposed along a side of the storage unit for preventing opening movement from the closed position of all but one of the storage units in response to the opening of one of the storage units. Control means is connected to the locking means for locking and unlocking the locking means. The control means includes input means for receiving an input code, data memory means for storing an access code, processor means for receiving and comparing the access with the input code to produce an unlocking signal when the access code has a predetermined relationship with the input code, and means operatively connected to the locking means and responsive to the unlock signal for moving to the unlock position to allow opening of one of the storage units. Also included are locking means associated with the plurality of storage units having a locked condition for locking the storage units in the closed position and an unlocked condition responsive to the unlock condition for unlocking and allowing each of the storage unit to move to the open position.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
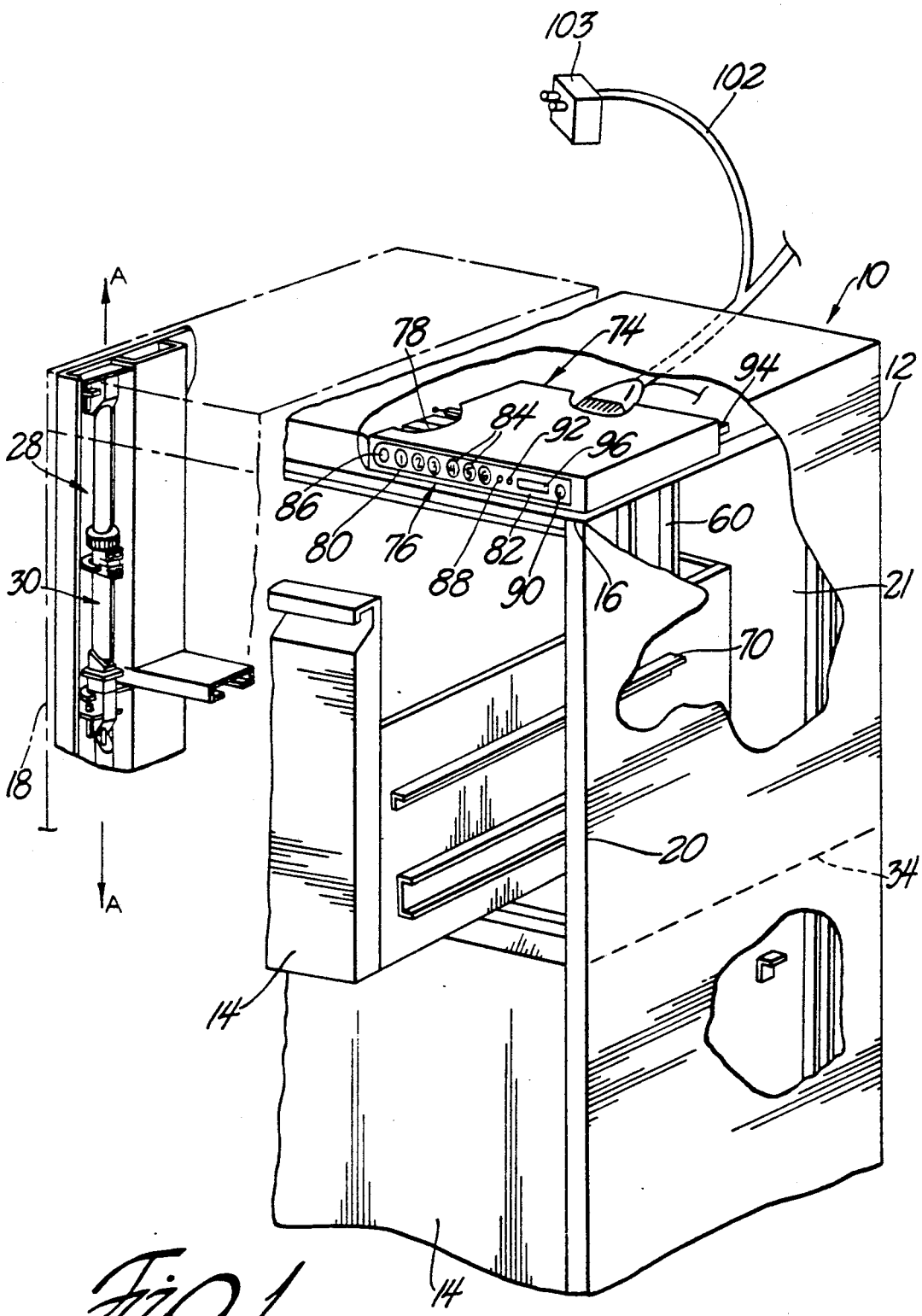
FIG. 1 is a perspective view partially cut away of the subject invention.

A storage assembly is generally shown at 10 in FIG. 1. The storage assembly 10 includes a housing 12 for defining an enclosure. The housing 12 includes a plurality of storage units 14. The storage units 14 are supported by the housing 12 for movement between a closed position and an open position. The structure is recited in U.S. Pat. No. 4,772,078, issued Sep. 20, 1988 in the name of Bowyer, and assigned to the assignee of the subject invention, and is incorporated by reference herein with modifications identified in the embodiments. The housing 12 includes an upper or top portion 16 and a bottom or base (not shown). Left and right side walls 18, 20 extend between the top portion and base and are interconnected at the rear by a rear wall 21. The top portion 16, base, left side wall 18 and right side wall 20 and rear wall 21 define the enclosure.

The housing means 12 is segmented into vertical units extending one upon the other at mating lines or seams 34. The vertical segments or sections may of various different vertical heights to accommodate storage units or drawers 14 of various different vertical heights or depths. A plurality of storage units are included, but only two are indicated at 14 in FIG. 1. Each of the storage units 14 are supported by a drawer slide 26 hung from the housing 12 for movement between the closed position within the enclosure and the open position as indicated in FIG. 1 extending out of the housing 12.

Figure 2:
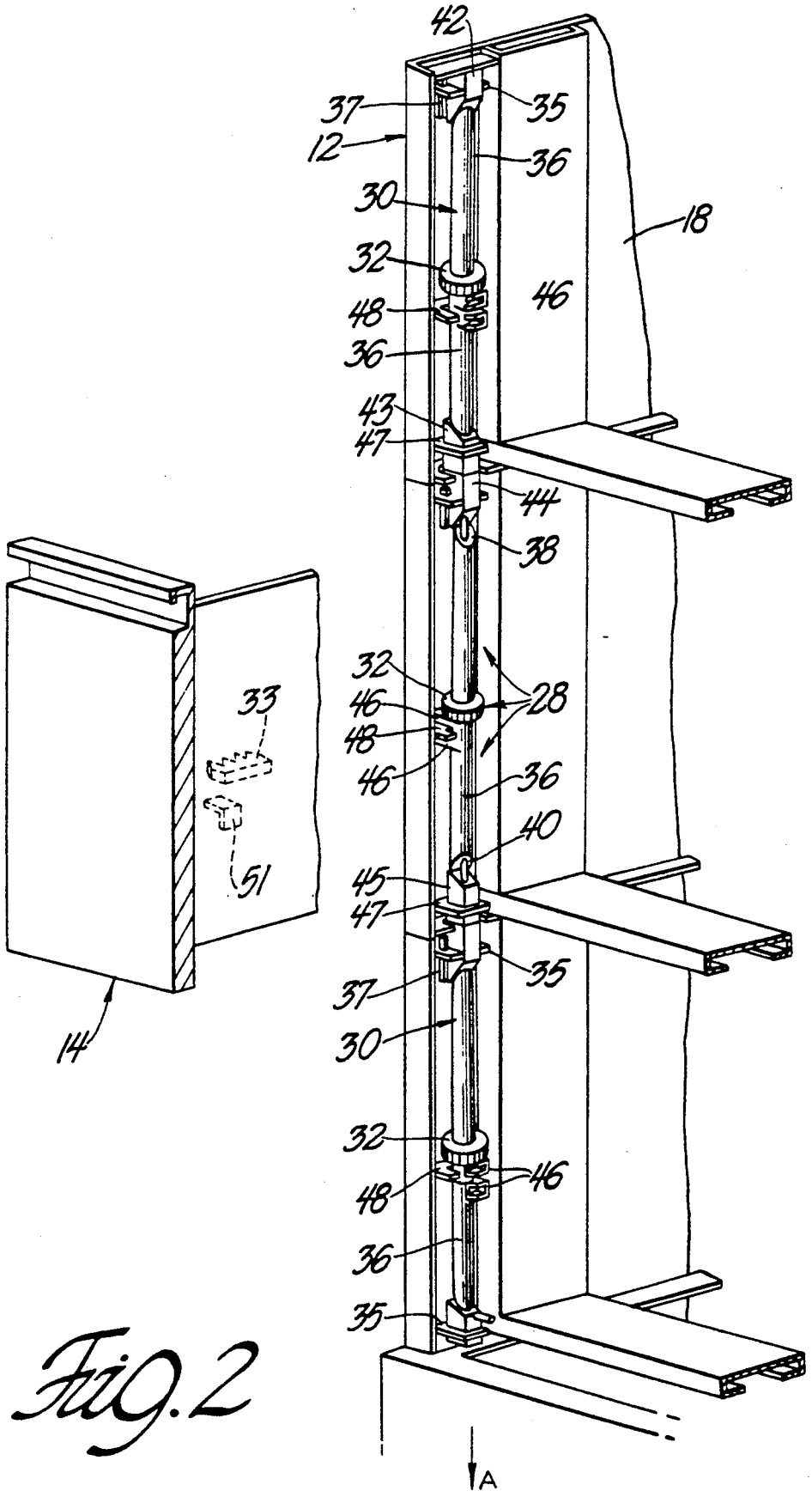
FIG. 2 is a fragmentary perspective view of the blocking means with one drawer opened.

As generally indicated in FIG. 2 and further discussed in the referenced patent, the storage assembly 10 includes blocking means 28 disposed on the vertical axis A along the left side wall 18 of the storage assembly 10 for preventing opening movement from the closed position of all but one of the storage units 14 in response to opening movement of one of the storage units 14. The blocking means 28 may be disposed on either side of the assembly 10. The blocking means 28 includes a control member 30 associated with each storage unit 14. Each control member 30 is vertically moveable between a neutral opening position allowing opening movement of the associated storage unit 14, and upper and lower blocking positions respectively above and below the neutral opening position for preventing opening movement of the associated storage unit 14 in either blocking positions and for vertically moving all of the control members 30 to their respective blocking positions while remaining in the neutral opening position in response to initial opening movement of the associated storage unit 14. The center control member 30 illustrated in FIG. 2 is disposed in the vertically actuated position with the top storage drawer units 14 open. When a storage unit 14 is moved to the open position, the associated control member 30 remains in the vertical neutral opening position while vertically moving any top control member 30 vertically upwardly to the upper blocking position and any lower control member 30 downwardly to the lower blocking position for preventing opening movement of upper and lower storage units 14.

Each control member 30 includes a transmission means comprising a pinion gear 32 coacting with a rack 33 on the associated storage unit 14 for rotating the control member 30 between an unactuated position and an actuated position. Each drawer storage unit 14 includes the rack 33 disposed on the side thereof and extending lengthwise in the direction of the opening movement for engaging and rotating the pinion gear 32 of the associated control member 30 during opening movement thereof. Each control member 30 includes a shaft 36 having a top and bottom end. Each control member 30 includes shifting means defined by the cam surfaces 38, 40 at the top and bottom ends. The cam surfaces are inclined relative to the vertical axis A for vertically moving all other control members 30 from their respective neutral positions to respective blocking positions in response to rotation of the one selected control member 30 from the unactuated position to the actuated position. The blocking means 28 includes link means comprising a plurality of link elements 42, 43, 44 between next adjacent control members 30 and movably supported by the housing 12 for vertical movement. The link elements 42, 43, 44, 45 are responsive to the cam surfaces 38, 40 of the shifting means for vertically moving all of the control members 30 in response to rotation of one of the control members 30 from the unactuated position upon initial opening movement of the associated storage unit 14. Each of the link elements 42, 43, 44, 45 present an inclined cam surface for mating surface-surface engagement with the cam surfaces 38, 40 when the assembly is in the neutral position.

Each of the control members 30 includes a pair of vertically spaced lugs 46 extending radially from the shaft 36 for blocking engagement with the associated storage unit 14 when in either of the upper or lower blocking positions and for rotating with the shaft 36 to the actuated position. Projection 48 extend from the housing 12 in vertical alignment with the space between the lugs 46 so that the projection 48 is disposed between the lugs 46 upon rotation of the shaft 36 by the pinion gear 32 from the unactuated position to the actuated position. Accordingly, the projections 48 define key means which coacts between the housing 12 and the control member 30 for limiting vertical movement of the control member 30 to the neutral position during rotation thereof between the unactuated and actuated positions as shown by the centrally disposed control member 30 of FIG. 2. The assembly also includes guide means defined by the brackets 35 and 37 extending from the housing 12 for preventing rotation of the link elements 42, 43, 44, 45 about the vertical axis A while at the same time guiding vertical movement thereof. The brackets 35 are U-shaped but include an additional groove in the U-shaped pocket for receiving the laterally extending key 37 extending laterally from some of the link elements 42, 43, 44, etc. for preventing removal of the link elements from the brackets 35. Other brackets 47 present closed openings through which the link elements are disposed. The link elements 42, 43, 44 have four-sided cross sections to coact with the brackets 35, 47 to prevent rotation of the link elements about the vertical axis A. Specifically, the link elements are square in cross section. The link elements include top elements 42, 44 engaging the top ca surface 38 of the control member 30 and bottom elements 43, 45 engaging the bottom cam surface of the control means 38. One of the top elements 42, 44 mates with one of the bottom elements 43, 45 at the division surfaces 34 between next adjacent housing sections or storage units or the openings therefor. In this manner, at least one shaft 36 and top 42 and bottom 43 elements are associated with each storage unit or opening in the housing enclosure. The further structure is disclosed in the referenced patent, including the lost motion means, spring, stop means.

A tab 51 extends from the side of each storage drawer unit as shown in phantom in FIG. 2. Each horizontally extending tab 51 is in vertical alignment with the space between the lugs 46 when in the neutral position. However, the tab 51 is aligned for blocking engagement with one of the lugs 46 when the lugs 46 have been vertically shifted to one of the upper or lower blocking positions as in the case of the upper and lower control means 30 in FIG. 2. The blocking means 28 is more fully discussed in the reference patent.

The assembly 10 includes locking means 60 independent of the blocking means 28 preventing all of the storage drawer units 14 from being opened in the locked position. The locking means 60 includes a locking bar 62 supported for vertical movement by brackets 64 extending from the housing 12 along the opposite or right side of the storage units 14. The locking bar 62 is adapted to be moved from an unlocked position to a locked position by vertically moving the bar upward to unlock and downward to lock. The locking bar 62 includes a locking lug 68 for blocking horizontal engagement with locking shafts 70 on the storage unit 14 when the locking bar 62 is lower or locking position. Actuator means 72, 72', 72" is included to control actuation of the locking bar 62 between the locked and unlocked positions. The invention includes three specific embodiments of the actuator means 72, 72', 72" as subsequently discussed.

Controller means 74 produces a drive signal to control the actuator means 72, 72', 72" locking and unlocking as also subsequently discussed. The control means 74 operates the different embodiment actuator means 72, 72', 72". Each of the actuator means 72, 72', 72" utilizes and operates on the locking bar 62 for moving between the locked and unlocked positions. Similar primed reference numerals indicate similar components.

Figure 3:
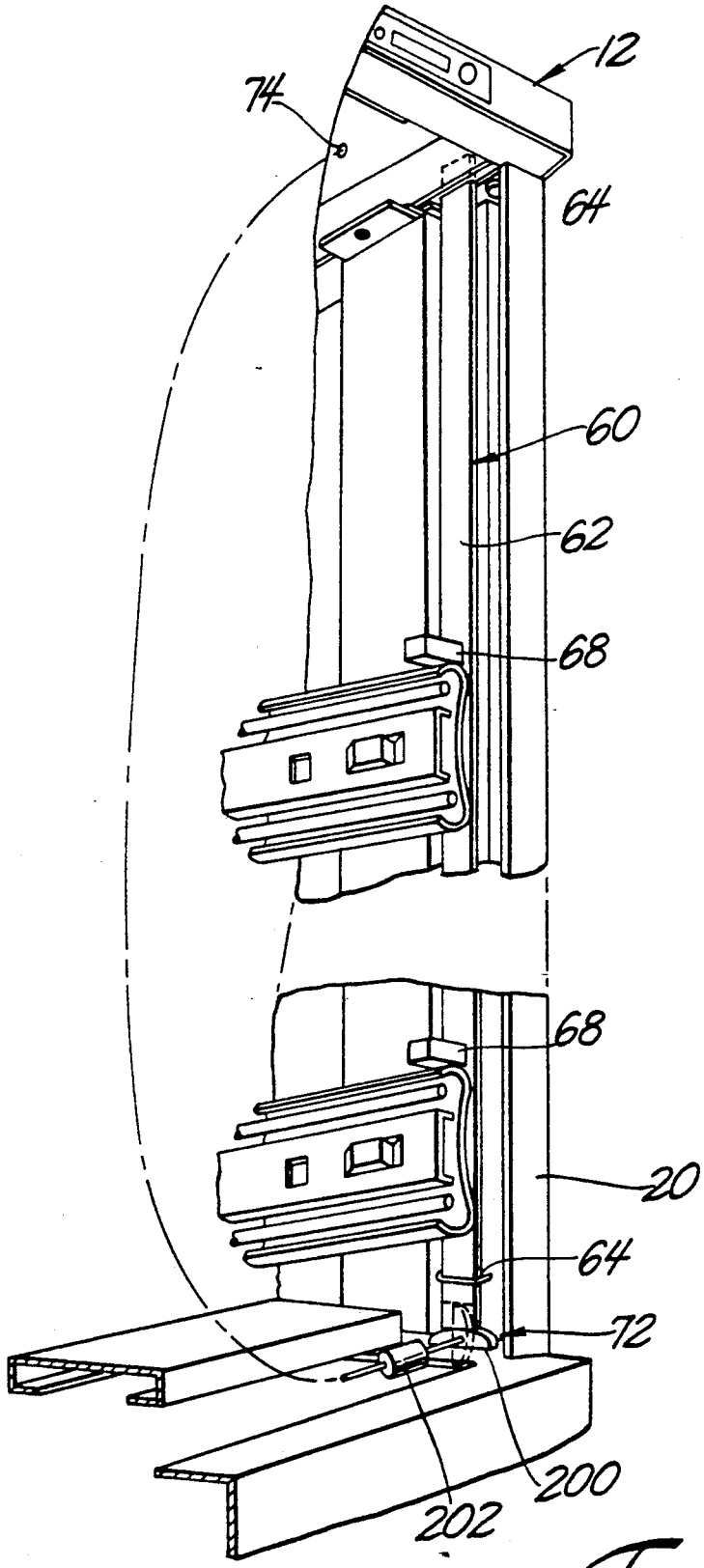
FIG. 3 is a perspective view of a first embodiment of the actuator means of the subject invention.

The first embodiment of the actuator means 72 is illustrated in FIG. 3. A cam 200 is placed along the side wall 20 of the housing 12 below the locking bar 62. The cam 200 is pivotable by a motor 202. The motor 202 is driven by a pair of motor relays 203, 205 which receives the control or drive signal from the controller means 74 and drives the motor 202 to rotate the cam 200 from an unrotated position to a rotated position (in phantom) to raise the locking bar 62. When the locking bar 62 in its lowermost or locked condition, the storage units 14 will be locked within the storage assembly 10 by the locking lug 68 aligned with and abutting the locking shafts 70. When the locking bar 62 is moved to its upper position upon rotation of the cam 200, the locking lugs 68 on the locking bar 62 are raised out of position or alignment with the shafts 70 on the storage units 14 allowing opening thereof. When a storage unit 14 is opened, the lugs 68 maintain the locking bar 62 raised in the unlocked position by sliding along the locking shafts 70 for the length of the storage unit 14. The blocking means 28 will allow only one storage unit 14 to open. The control signal from the controller means 74 produces a forward control signal to the forward relay 203 for a predetermined time to raise the locking bar 62. The controller 74 will produce a reverse signal to the reverse motor relay 205 to cause reversal of the motor 202 to move the locking bar 62 to the locked position. The forward control signal is produced after validation of the input code and depression of the number one key 84, and the reverse control signal is produced after a subsequent depression of the number two key 84. The user of the assembly 10 may open a storage unit 14 any time after the number one key is depressed and prior to depression of the number two key, after which an input code must be re-input.

Figure 4:
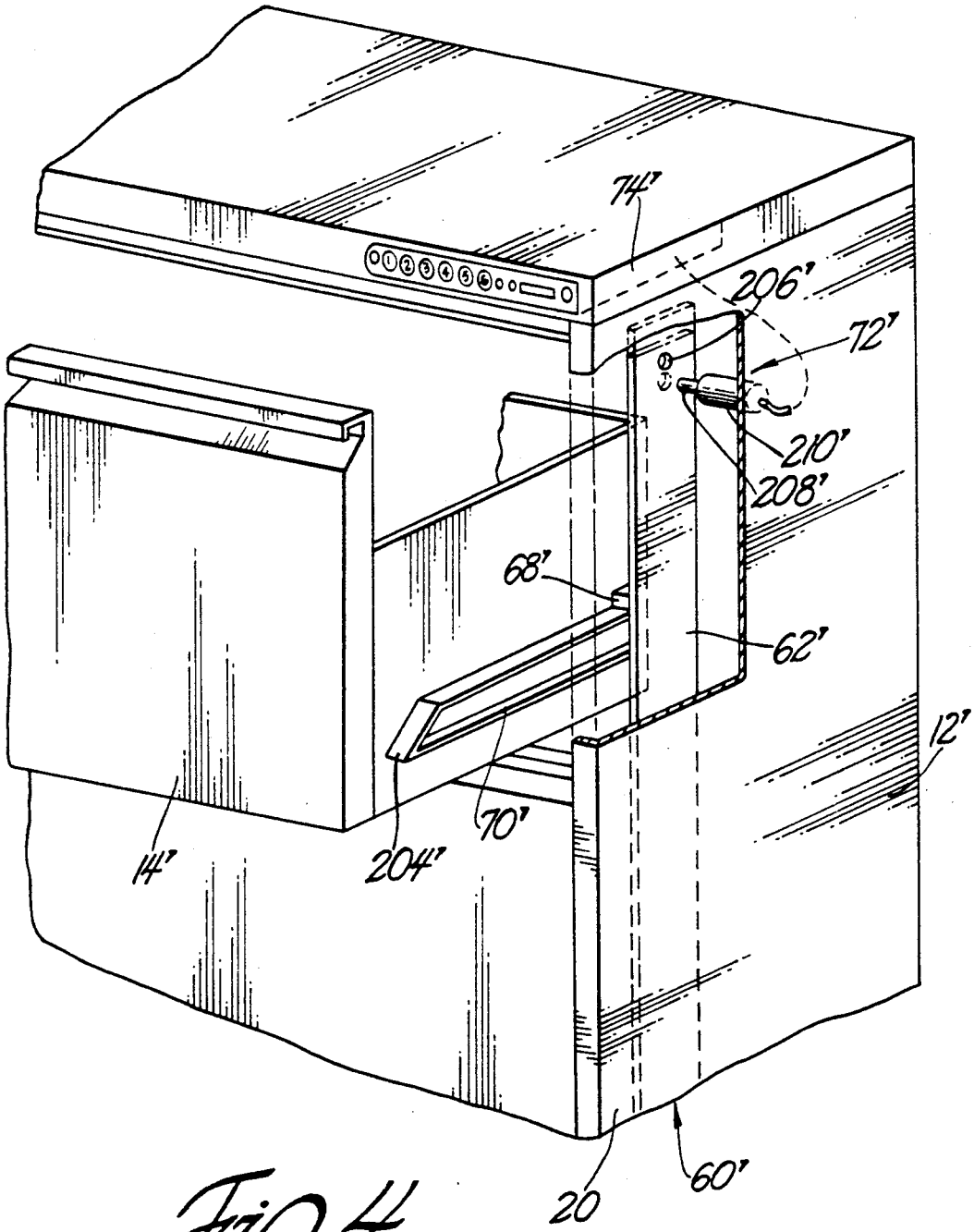
FIG. 4 is a perspective view partially broken away of a second embodiment of the actuator means of the subject invention.

The second embodiment of the actuator means 72' is illustrated in FIG. 4 wherein the locking shaft 70' includes a ramp portion 204' connected to the storage unit 14', and the lug 68' is connected to the locking bar 62'. The locking bar 62' includes an aperture 206' in its upper end for receiving a plunger 208' of a solenoid 210'. The solenoid 210' is operable to extend and retract the plunger 208' into and out of the aperture 206'. The plunger 208' is spring biased to the extended position so that absence of a control signal will cause extension of the plunger 208'. The control signal supplied to the solenoid 210' will cause retraction of the plunger 208'. When the locking bar 62' is in its lowermost or locked position, the plunger 208' extends into the aperture 206' (in phantom) thereby preventing movement of the locking bar 62' and preventing opening of the storage units 14'. Upon reception of a control signal from the controller means 74' the solenoid 210' retracts its plunger 208' for five seconds. Upon retraction thereof, the locking bar 62' may be raised to the upper or unlocked position (in phantom). Upon opening of the storage unit 14', the ramp portion 204' contacts the lug 68' to slide the locking bar 62' upward into the unlocked position. Upon leaching of the solenoid 210', the plunger 208' is biased to the extended position to the locking bar 62'. Because the aperture 206' is out of alignment, the locking bar 62' is not locked at this position. Once the opened storage unit 14' is closed, the locking bar 62' will lower due to gravity and the plunger 208' will slide in the aperture 206' to again lock the locking bar 62'. The lower end of the locking bar 62' is as in the first embodiment of FIG. 3 absent the cam 200 and motor 202 such that the lowermost position of the locking bar 62' against the base of the housing 12' aligns the aperture 206' with the plunger 208'.

Figure 5:
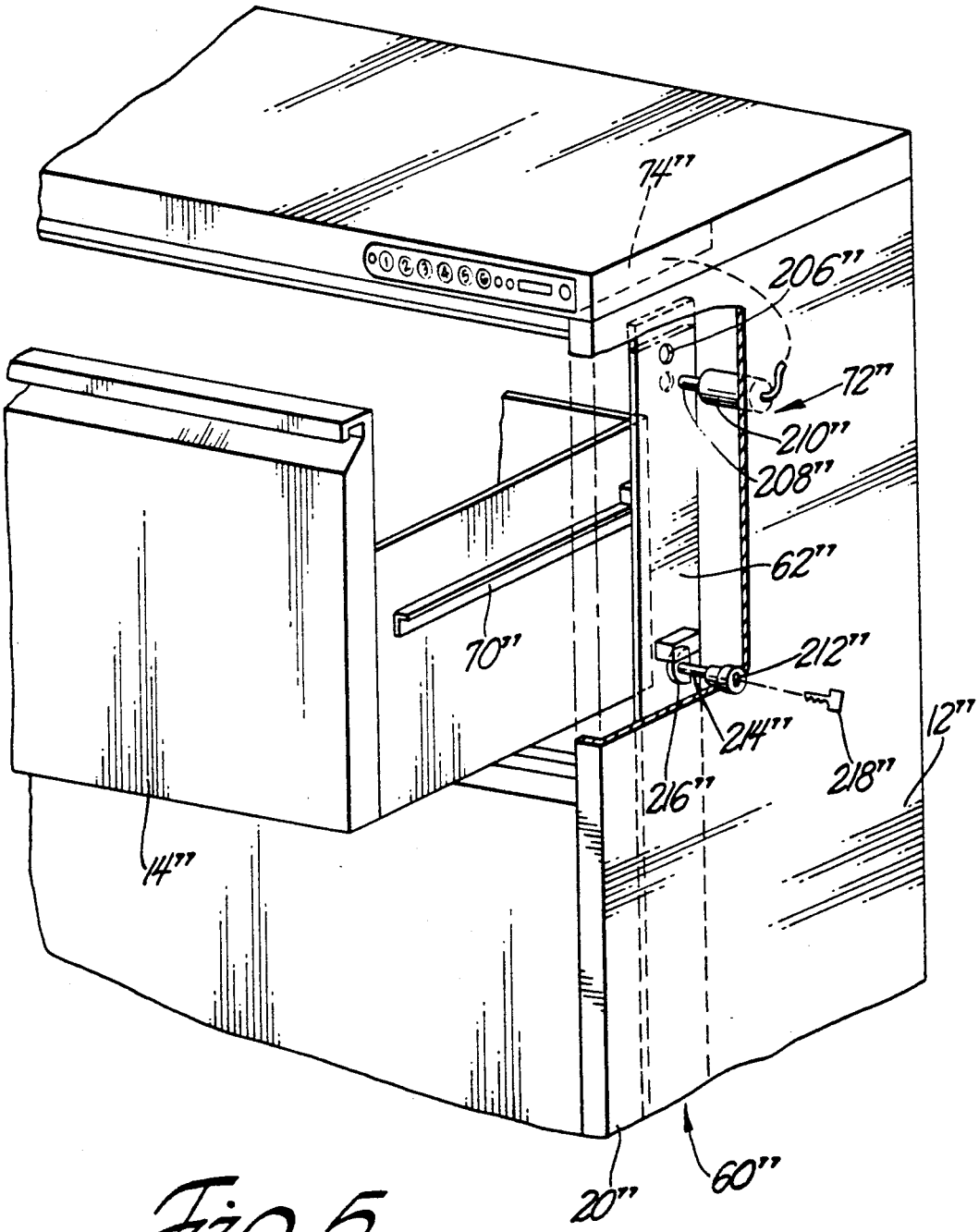
FIG. 5 is a perspective view partially broken away of a third embodiment of the subject invention.

The third embodiment of the actuating means 72'' is illustrated in FIG. 5 and includes the solenoid 210'', plunger 208'', aperture 206'' and locking bar 62'' are the same as in the second embodiment 72'. However, movement of the locking bar 62'' between the locked and unlocked positions occurs by mechanics. The housing 12'' includes a key hole 212'' having a shaft 214'' extending to a cam 216''. Upon insertion of an appropriate key 21S'' and turning thereof, the cam 216'' rotates from an unrotated position to a rotated position raising the locking bar 62''. Therefore, upon production of a control signal, the solenoid 210'' will retract for five seconds. The user must insert and rotate the appropriate key 218'' within this time to raise the locking bar 62'' to the unlocked position. Thereafter, the solenoid 210'' will release the plunger 208''. Upon manually returning the key 208'' to the unrotated position, the locking bar 62'' will lower allowing the plunger 208'' to lock the bar 62''.

The control means 74 includes input means 76 and processor means 78. The input means 76 receives an input code and the processor means 78 decodes the entered input code and grants or denies access to the storage unit 14 according to validity of the code by controlling the actuator means 72. The actuator means 72 is responsive to the processor means 78 for actuating and moving the locking bar 62 into or out of the actuated and unactuated positions. The input means 76 includes a keypad 80 and an indicator panel 82. The keypad 80 includes six depressible keys 84 numbered 1, 2, 3, 4, 5, 6. These six numbered keys 84 utilized for the input of input codes. A colored key 86, generally green in color, allows for initial setup and access coding of the processor means 78. A light 88, generally green in color, is included on the indicator panel 82 and indicates that access has been checked and authorized, and that a storage unit 14 may now be opened. Also included on the keypad 80 is a red color key 90 used for depression to manually lock the storage units 14. A power supply terminal 92 is included for receiving a temporary or emergency battery power supply for the processor means 78. The housing 12 includes a reset button 94 located in a generally obscure area of the housing 12. The reset button 94 may be depressed in order to reprogram the access when only one access code is utilized. The input means 74 includes a program input 96 adapted to be attached to a remote programming unit 98 which is capable of setting a plurality of access when a plurality of access codes are utilized. The remote programming unit 98 allows communication to the processor means 78 through a serial line and includes a keyboard thereon for inputting and changing access codes, and does not form part of the invention. Such programming unit may be that disclosed in U.S. Ser. No. 648,967, filed Jan. 31, 1991 and assigned to the assignee of the subject invention.

Figure 6:
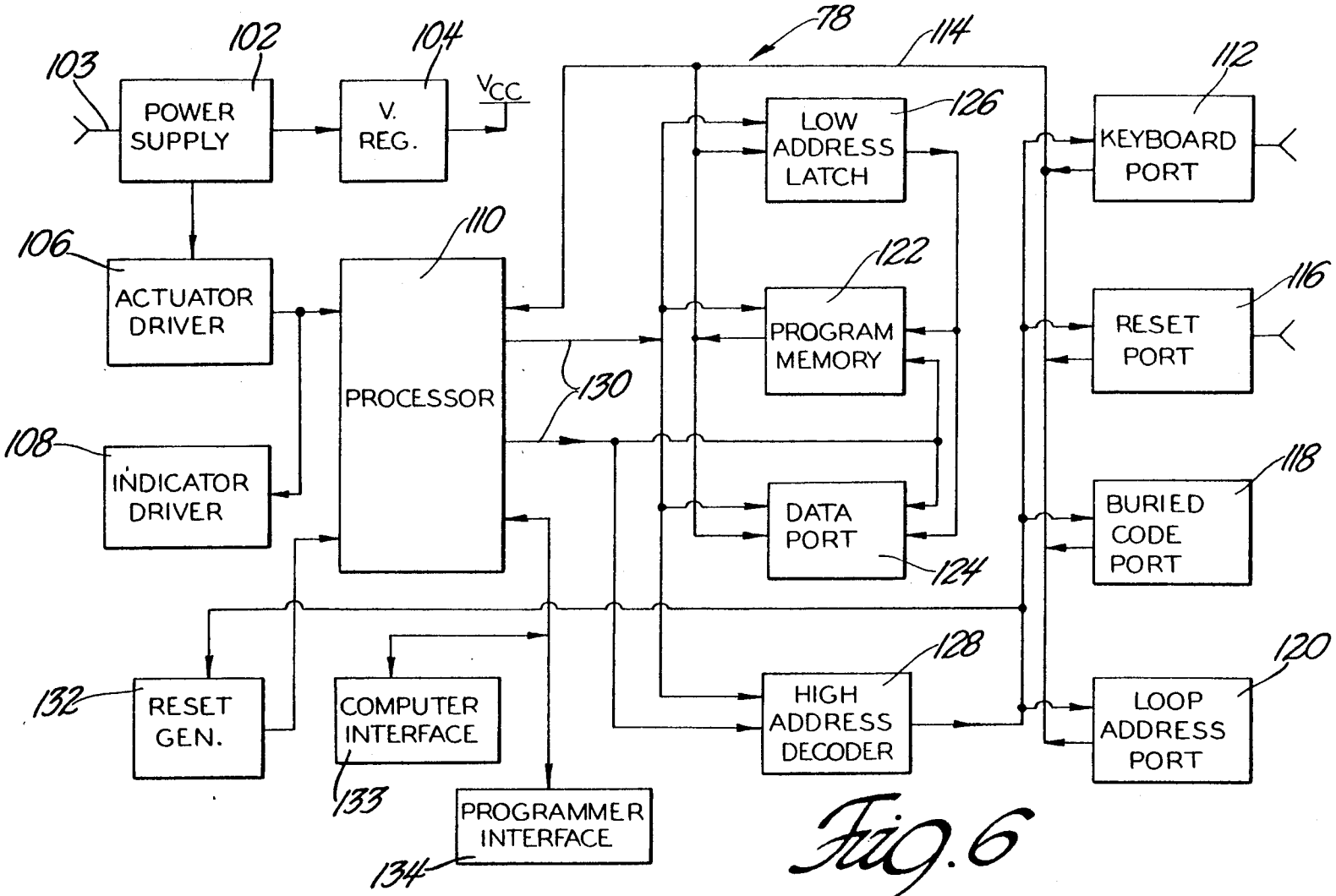
FIG. 6 is a general block diagram of the control means of the subject invention; and FIGS. *7a–b* are circuit diagrams of the control means of FIG. 6.
Figure 7A:
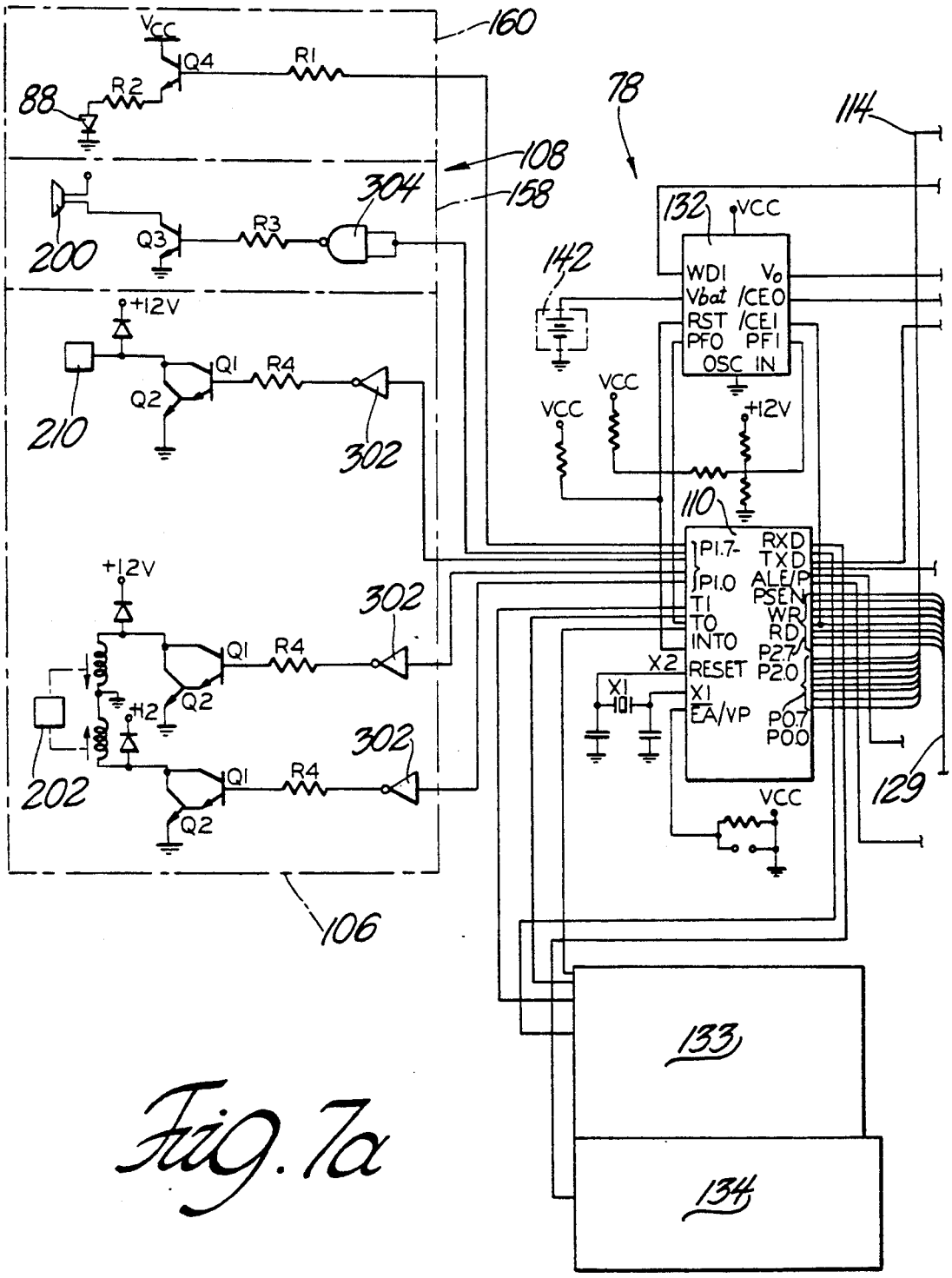
Figure 7B:
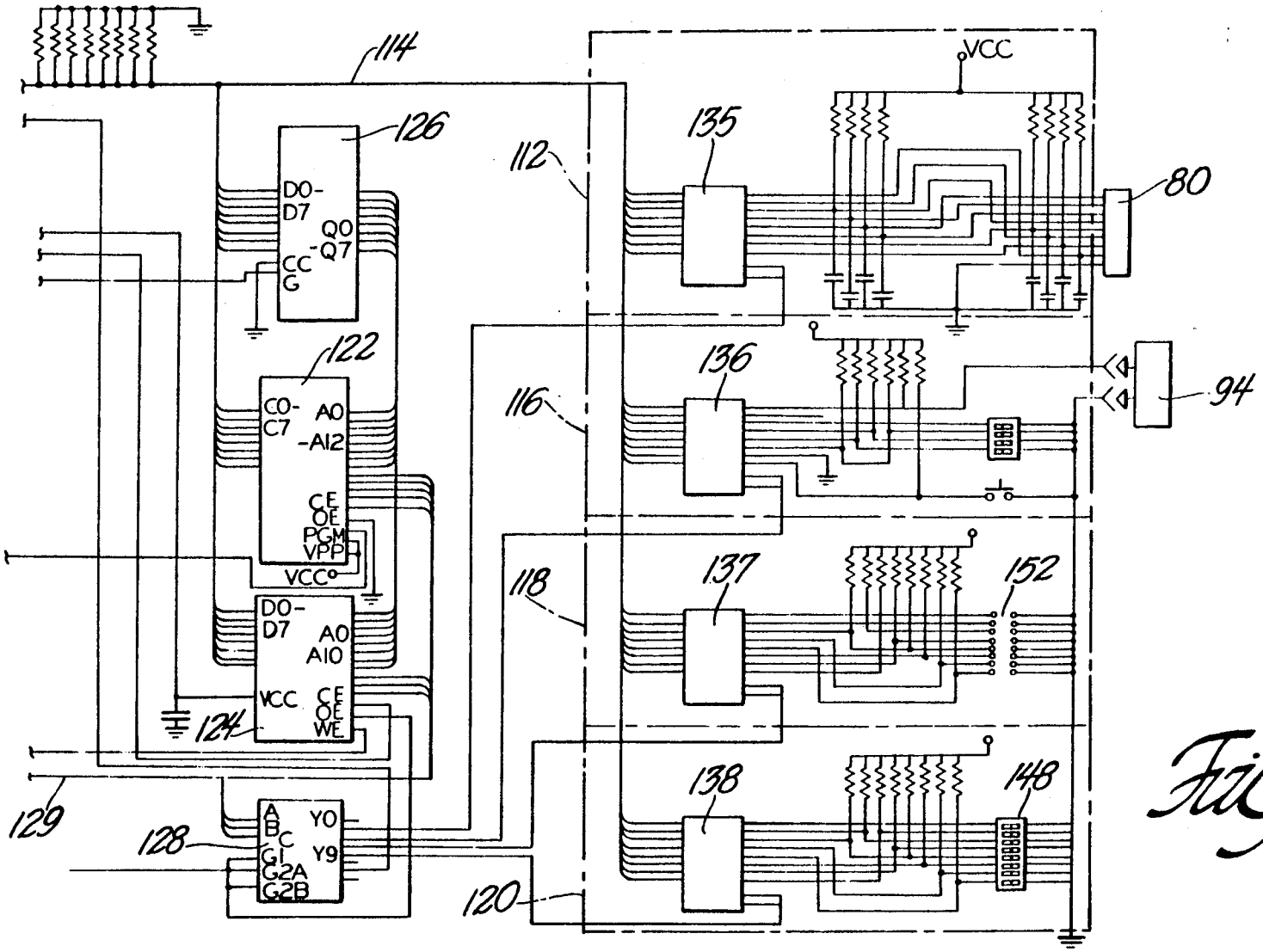

As illustrated in FIG. 6, the control means 74 includes a power supply 102 which is connected to AC line voltage via a line plug or hard wire connection. A 12 volt AC converter power supply may be connected directly to a wall outlet and to the cable/plug 103 with a two conductor cable and miniature plug. This is used for a single stand alone storage assembly 10 or cabinet of storage units 14. The supply also supplied a nominal 12 volt DC. The power supply 102 is connected to the remainder of the control means 74 wherein a nominal 12 volt DC is delivered.

The step down voltage regulator 104 is connected to the power supply 136 and is comprised of a LM7805 integrated circuit and appropriate decoupling capacitors. The voltage regulator 104 delivers five volts DC to the other portions of the control means 74.

Also included is actuator driver means 106 connected to the power supply 102. The actuator drive means 106 is responsive to the processor means 78 to produce the unlocking or control signal to actuate the locking bar 62 for allowing opening of the selected storage unit 14. Indicator driver means 108 is also connected to power and responsive to the processor means 78 to actuate the green light 88 and provide audio indication for indicating the authorized access to the storage units 14 or disallowance thereof.

The control means 74 includes a processor 110 which receives inputs of codes and authorizes opening of the storage units 14. The processor 110 is connected to and controls the actuator driver means 106 and the indicator driver means 108.

The keyboard 80 is connected to input port means 112 which receives the coding of the keys 84 depressed and transmits an 8-bit data signal indicative of such actuation to the processor 110 via a data bus 114. The reset port means 116 is connected to the reset button 94 wherein the code transmitted by the reset port means 116 includes the status of the reset button 94. Also included is coding port means 118 for providing a key code for the storage assembly 10 which may also be used as an access code. Loop address port means 120 identifies which storage assembly 10 of several on a network is transmitting data when several are utilized with the same external computer or to identify if communication is requested with the particular storage assembly 10.

The processor means 110 is connected to program memory 122, data memory 124, low address latch 126 and high address decoder 128. The program memory 122 stores the operating program code for the processor means 110. The data memory 124 stores the access codes and information regarding the history of accessing the storage assembly 10. The low address latch 126 provides the lower address byte and the high address decoder 128 provides the higher addressing byte for addressing the program 122 and data memory 124 and ports 112, 116, 118, 120. The low order address is demultiplexed from the data bus 114 by the low address latch 126. The high address decoder 128 decodes the high order address from an address bus 129 connected to the processor 110. A control signal line 130 is connected to and provides control signals to the low address latch 126, program memory 122, data memory 124, and high address decoder 128.

The processor 110 is also connected to reset generation means 132 and computer interface 133 and programmer interface means 134. The reset generation means 132 holds the processor means 78 in a reset condition during power-up and also disables the processor means 78 with a reset if the input voltage falls below a predetermined level to prevent erroneous data from being written into the data memory 124 during power-up and power-down. Additionally, the reset generation means 132 will reset the processor 110 during error interruption thereof. The computer interface means 133 allows the processor 110 to communicate with a personal computer. The programmer interface means 134 allows the processor means 110 to be programmed and deprogrammed with access codes by the remote programming means.

The more specific circuitry is illustrated in FIGS. *7a–b*. The processor 110 comprises an 8 bit CMOS micro controller (Intel 80C31). The processor 110 is used in the external addressing mode to read its operating microcode from program memory 122, store and retrieve data in external data memory 124, and control the four 8-bit input port means 112, 116, 118, 120. The data bus 114 interconnects each of the above. The port means 112, 116, 118, 120 include four separate 8-bit three state buffers (74HC244) 135, 136, 137, 138 plus external circuitry. When enabled, these buffers 135–138 place the contents of their input onto the 8-bit data bus 114. The low order 8-bit address is demultiplexed from the data bus 114 by the lower address latch 126, comprising an 8-bit latch (74HC373). The latch 126 stores the address that is present on the data bus 114 during the first portion of the instruction cycle on the falling edge of the address latch enable (ALE) control signal. This latched address is delivered to the program memory 122 and the data memory 124. The high order address bus 129 is output directly from the processor 110 and delivered to the program memory 122, the data memory 124, and the high address decoder 128. The high address decoder 128 decodes the high order address along with the data read control signal from the processor 110 and delivers a dedicated read signal to each of the four 8-bit buffers 112, 116, 118, 120. The dedicated read signal is also delivered to the reset generation means 132 to continually reset the reset generation means 132.

The processor 110 receives the program code from the data contained in the program memory 122, which memory 122 is a typical EPROM (27C64).

The EPROM 122 is read when the processor 110 brings the /PSEN (program store enable) line low. This enables the /OE pin (output enable) of the EPROM 122 and places data on the data bus 114. The address decoding is handled by the high address decoder means 128 (74HC138). The address decoder 128 is a demultiplexer which decodes the upper address bytes of the address bus 129 and "ORs" the read line 130 with the address to control the buffers 135–138.

The processor 110 clock is controlled by crystal Xl. This crystal Xl oscillates at 11 MHz and is divided by 12, by the processor 110, to produce a system clock period of 1.09 microseconds.

Access code are stored in the external data memory 124. This memory 124 is a 2K×8 static RAM. This RAM 124 is battery backed by batteries 142.

The reset generation means 132 includes a system reset which will hold the processor means 78 in a reset condition during power up, and disable the processor means 78 with reset if the input voltage falls below a predetermined level. This prevents erroneous data from being written into the data memory 124 during system power up and down. The reset generation means 132 also contains a watch dog timer. During proper operation of the processor means 78 this watch dog timer is continuously reset with a read signal. If for some reason the processor 110 program loses its place, this read signal will not occur at a regular interval and the watch dog timer will reset the processor means 74 to normal operation. The reset generation means 132 also included power monitoring for performing the battery backup functions for the data memory 124. The power monitoring will monitor the voltage to the processor 110 and will switch to the battery 142 when the voltage falls below a predetermined limit.

The system generation means 132 comprises a process supervisory chip (MAX691). The supervisory chip 132 contains internal timers that generate system reset time out and watch dog timer time outs. These timers are set to supply a 50 millisecond reset pulse on power up of the processor means 78 and generate a reset 100 milliseconds after the last watch dog reset interrupt. The watch dog timer is used to insure that the processor 110 system remains on line and functioning. If, for some reason, the processor 110 were to be lost in the execution of the program code or quit issuing regular watch dog reset interrupts, the watch dog timer would tim out and reset the system to proper operation. When the system power is first turned on to the processor means 78, the reset output of the supervisory chip 132 (RST) is held high for 50 milliseconds to reset the processor 110. The watch dog timer will not issue its reset pulse for 1.6 seconds after initial turn on of the processor 110. This is to allow the software to initialize. Before 1.6 seconds has lapsed, the watch dog timer must be interrupted with a watch dog reset interrupt or the processor 110 will reset from start again. After the first watch dog reset interrupt must be issued at least every 100 milliseconds or the timing chip 46 will reset the processor 110. The processor 110 outputs a watch dog interrupt every few milliseconds from the high order address decoder means 128. This assures that the watch dog timer will not reset the processor 110 during operation. The signal can be seen as a /RD pulse on the input of the timing chip 132 and is a good indication that the processor 110 is functioning properly. The supervisory chip 132 also performs battery back-up functions by the power monitoring means. Pin labeled PFI is the power fail input. This PFI input monitors the positive DC voltage supplied to the voltage regulator 104 through a resistor divider and indicates to the processor unit 110 that power is on its way down by raising is power fail output labeled PFO. The processor 110 receives the signal on its interrupt input INT1. When the signal on its interrupt input INT1. When the processor 110 sees this INT1 go high, it immediately holds all operations and waits for power to fail. The supervisory chip 132 also "gates" off the chip select line /CEO to the RAM or data memory 124. This prevents the writing of erroneous data into the RAM 124 during power down. Battery power backup by battery 142 is the provided through the supervisory chip 132 to the RAM 124.

The loop address port means 120 also includes eight dip switches 148 which are manually set to establish a loop address. The coding of the loop address selects identifies the particular storage assembly 10 for communication purposes. During communication request, the loop address is read to determine if the communication request is directed toward that particular storage assembly 10. The loop address is read by reading address 8000H. This address enables the loop address selector 1G, 2G of the loop address buffer 138 and places the packed BCD equivalent of the loop address on the data bus 114.

The coding port means 118 includes eight jumpers 152 which may be cut in any combination to set a buried code. The buried code is related to the serial number of the storage assembly 10. The buried code establishes a key code which acts as an access code when all access codes in the data memory 124 have been compared with no match. If the input code matches the key code, any storage unit 14 assigned unit number one may be opened. The buried code program jumper port buffer 137 is read by reading address 6000H. This address enables the buried code program jumpers and places the buried code value or key code on the data bus 114.

The reset button 94 is read by reading address 4000H. The reset button 128 is a standard momentary electrical contact switch which will set one bit of the code.

The front panel keypad 80 is read by reading address 2000H. This address enables the keypad input port buffer 135 and places the value of the keys 84 depressed from the front panel keypad 80 on the data bus 114. The keypad 80 includes the numbered keys 84, green key 86, and the read key 90.

The locking bar 62 is controlled by the actuator driver means 106 through production of the unlocking or control signal. The driver means 106 switches the nominal twelve volt DC power with Darlington transistors Q1, Q2 to drive the respective solenoid 210 or motor 202.

The indicator driver means 108 includes audible means 158 and visual means 160. The audible means 158 is driven by switching the nominal 12 volt DC by a transistor Q3 to a transducer 162. The visual means 160 includes switching the five volt DC power supply with a small signal transistor Q4 to operate the green light 88, which is comprised of an LED. These transistors Q1–Q4 are controlled directly from the 8-bit output ports P1.0–P1.7 of the processor 110.

Output port P1.7 of the processor unit 110 drives the green light 88. Port P1.7 is connected through a resistor R1 to drive a switching transistor Q1 to a resistor R2 driving the green LED 88. Port P1.6 is inverted by a dual input NAND gate 304 to a resistor R3 driving transistor Q3 which drives the audio transducer 200 with its collector. The port P1.0 is connected to the solenoids 210', 210'', depending on the embodiment of the locking means 60 utilized. Port P1.1 is connected to the forward motor relay 203 to drive the motor 202 in the forward direction when the number one key 84 is depressed in the proper sequence. Port P1.2 is connected to the reversing motor relay 205 to reverse the motor 202 when the number two key 84 is depressed in the proper sequence. The power supply terminal receives a 12 volt battery supply to directly power the solenoids 210', 210'' or motor 202 to allow opening of any one of the storage units 14 in the case of an emergency.

General operation will be first explained. When pressing the keys 84, 86, a short tone indicates that the entry is acceptable, and a long tone indicates that the entry is unacceptable. Therefore, a long tone will occur upon depressing keys 84, 86 out of sequence or incorrect key depression. With regard to opening storage units 14, new storage assemblies 10 are provided with a predetermined access code. The green key 86 on the keypad 80 is first depressed. The processor 110 receives a data signal indicative of green key 86 depression. After pressing the green key 86, the input code equal to the access code are sequentially pressed on the keypad 80. The access code is prestored in RAM 124 within each new storage assembly and provided in literature thereof. The value of the matrix keypad 80 is received having the input code equal to the access code. The processor 110 compares the input code to the stored access codes in RAM 124, and energizes the green light 88 if a valid comparison is made. When the green light 88 comes on and there is a short audible tone, the storage assembly 10 is accessible by producing a control or unlock signal at port P1.0. If the green light 88 does not come on, or if a long tone is sounded, one must press the green key 86 and start the sequence again. With regard to opening a storage unit 14, once the green light 88 is on. The operator will have five seconds to pull a storage unit 14 open before the processor 110 locks the storage unit 14 or locking bar 62 in the second and third embodiments of the actuator means 72',72". In the first embodiment of the actuator means 72, the number one key 84 must be depressed after validation of the input code and illumination of the green light 88. After depression of the number one key, the forward control signal is supplied on port P1.1 to drive the motor 202 for unlocking. In order to lock, the number two key 84 is depressed causing production of the reverse signal on the port P1.2 to reverse the motor 202 and cam 200.

The vertical stack of link elements and control members 30 are supported in a vertically neutral position. In this vertically neutral position, the tabs 51 extending from each storage unit 14 are aligned with the space between the lugs 46. Upon the opening of a storage unit 14, the rack 33 thereof engages the associated pinion 32 to rotate the shaft 36 thereby rotating the lugs 46 clockwise as viewed from the top with the projection 48 disposed therebetween as illustrated by the middle storage unit 14 opening of FIG. 2. The projection 48 knifes the lugs 46 to prevent any substantial vertical movement of the associated shaft 36 thereby allowing the tab 51 of the storage unit 14 to move between the lugs 46 and out of the opening. At the same time, the cam surfaces effect a wedging action with the cam surfaces of the adjacent link elements to vertically move the adjacent link elements up and down at the case may be. The link elements are prevented from being rotated and are therefore forced upwardly and downwardly depending upon whether they are disposed above or below the rotated shaft 36. As illustrated in FIG. 2, the top shaft 36 is moved vertically upwardly because of the coaction between the camming surface at the top end of the middle shaft 36 and the next above link element to thereby move the lowermost lug 46 into blocking engagement with the tab on the adjacent top drawer. Accordingly, the storage unit 14 of the top opening in FIG. 2 is prevented from moving outwardly to the open position. In a similar but opposite position, the lower camming surface of the middle shaft moves the next adjacent like element downwardly to move the lowermost shaft downwardly to move the lug means to the lower blocking position with the tab on the adjacent or bottom drawer preventing is from being opened and moving the top lug of the pair into horizontal blocking alignment with the adjacent or lowermost projection. The shaft 36 rotated to the actuated position is rotated approximately 180° as shown by the middle shaft 36 in FIG. 2 so that the horizontal shelf surfaces rest upon one another to frictionally hold the shaft 36 in the rotated actuated position. When the storage unit 14 is returned to the closed position, the rack 33 thereof engages the pinion gear 32 to rotate the shaft 36 in the counterclockwise direction as viewed from the top to return the assembly to the unactuated vertically neutral position. The space for vertical movement of the entire stack of elements 14 is limited by the space between the uppermost link element and the housing 12 and the space between the lowermost link element and the housing whereby there is not sufficient room to rotate two of the shafts at the same time.

A storage unit 14 may be locked manually or automatically. To lock the storage unit 14 manually, the red key 90 is depressed, and a storage unit 14 closed.

With regard to setting a new access code, two configurations are available. A first configuration allows for the use of a single access code per storage assembly 10. A second configuration allows for multiple access codes. In the first configuration, in order to reset the access code stored in RAM 124, the present access code is entered on the keypad 80 and a storage unit 14 is opened. Thereafter, the reset button 94 is depressed. The reset button 94 is located within the housing 12 above the top or first storage unit 14, therefore the top storage unit 14 requires prior opening. The new access code is entered on the keypad 80. When the storage unit 14 is closed, the storage assembly 10 is looked and will only open upon input of an input code equal to the new access code.

With regard to the operation, the processor 110 in conjunction with the code stored in the program memory 122 produces the means by which the assembly 10 is controlled. The processor 110 continuously samples the input from the keypad input port 112. Interruption by the communication interfaces 133, 134 at pin RXD may occur at any time. The processor 110 upon reception of a value on the keyboard buffer 112 determines which key 84, 86, 90 is depressed. Upon a green key 86 depression, the keyboard input port 112 will place a value of this key on the buss 114. The processor 110 will sample the port 112 and provide the data over the data bus 114 to the processor 110. The processor 110 makes a comparison and if the value indicates green key 88 depression and a short tone is sounded by the audible transducer. The processor 110 again samples the keypad port 112. If the red key 90 is depressed and determined by the processor 110 the processor 110 locks the solenoids or motor by an absence of a control signal. If improper key inputting occurs, a long tone will occur and the processor 110 will restart its program.

Assuming correct sequence depression of the green key 86, the processor 110 steps through and sequentially samples the input buffer 112 to obtain the five digit input code. Upon receiving each of the numbered key 84 depressions as a digit, a short tone will occur if one of the keys 0–6 has been depressed. If five numbered keys 84 are not sequentially depressed, a long tone will be sounded and the processor 110 will restart its program. After receiving all five digits of the input code, a first access code is obtained from the data memory 124. The five digit input code is compared to the access code and if there is a match, a short tone is sounded and the green light 88 is illuminated. If there is not a match, the next access code is obtained from the data memory 124. The processor 110 continually steps through all of the available access codes from the data memory 124 until a match is obtained. If a match is not obtained after depletion of the access codes in the data memory 124, the processor 110 will sample the value on the buried code jumpers input buffer 118 to obtain the key code. If the input code matches the key code, access authorized. If the input code does not match the key code, no green light 88 is illuminated and a long tone will be actuated on the audible transducer.

Upon illumination of the green light 88 the processor 110 supplies the unlock signal to the driver 144 to in turn produce the control signal to the solenoids 210', 210". If a motor 202 is used, the processor 110 waits for depression of the number one key to rotate the motor 202 to unlock. The processor 110 then waits for the number two key depression to rotate the motor 202 for locking. After supplying the unlock signal for five seconds, the unlock signal is discontinued. If the reset key 94 is depressed, the data memory 124 is checked to determine the number of access codes. If the access code number is greater than one, a long tone is sounded. If there is only one access code, the new access code is received and placed in memory 124 over the old code.

If the red key 90 is depressed at any time when the 5 seconds has not expired, the solenoids 210', 210'', and motor 202 are automatically locked. If the reset key 94 is depressed after authorization of the input code with the access code and selection and opening of the first or top storage unit 14, a five digit code is sequentially read from the keyboard buffer 112. The processor 110 replaces this new code for the previously stored single access code. The reset key 94 can only be utilized if a single access code is stored. When the reset key 94 is depressed, the processor 110 checks the data memory 124 to determine if only one access code is stored. If more than one code exists, a long tone is produced.

The invention has been described in an illustrative manner, and it is to be understood that the terminology which has been used is intended to be in the nature of words of description rather than of limitation.

Obviously, many modifications and variations of the present invention ar possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A file cabinet apparatus comprising:

housing means (2) defining an enclosure;

a plurality of storage units (14) to be supported by said housing means (12) for moving between a closed position and an open position;

blocking means (28) disposed along a side of said storage units (14) for preventing opening movement from said closed position of all but one of said storage units (14) in response to opening of said one of said storage units (14), a locking bar (62) disposed along said storage units (14) having a locking position for locking all of said storage units (14) in said closed position and an unlocked position for unlocking all of said storage units (14) allowing operation of said blocking means (28);

control means (74) connected to said locking means (60) for locking and unlocking said locking means (60);

said apparatus characterized by said control means (74) including electric input means (76) for receiving an input code, electric data memory means (124) for storing an access code, processor means (110) for receiving and comparing said access code with said input code to produce an electrical unlocking signal when said access code has a predetermined relationship with said input code, and electronic actuator means (72) operatively connected between said control means (74) and said locking bar (62) for receiving said unlock signal to allow movement of said locking bar to said electrical unlocked position and an for retaining said locking bar in the locking position in the absence of said unlock signal.

2. An apparatus as set forth in claim 1 wherein said storage units (14) including locking shaft (70) extending from said second side, said locking bar (60) including locking lugs (68) extending therefrom for engaging said locking shaft (70) in said locked position to prevent opening of said storage units (14) and for moving out of engagement with said locking shaft (70) in said unlock position.

3. An apparatus as set forth in claim 2 wherein said actuator means (72) includes a cam (200) for rotating between an unrotated position moving said locking bar (62) to said locked position and a rotated position moving said locking bar (62) to said unlocked position, a motor (102) operatively connected to said cam (200) for receiving said unlocking signal and rotating said cam (200).

4. An apparatus as set forth in claim 2 wherein said actuator means (72') includes plunger means (208', 210') for moving between an extended position to contact and maintain said locking bar (62) in said unlocked position and a retracted position to disengage said locking bar.

5. An apparatus as set forth in claim 4 wherein said locking shaft (70) includes a ramp portion (204') at a first contact end for contacting said locking lug (68) upon opening of said storage unit (14') to move said locking bar (62') to said unlocked position when said plunger means (72') is in said retracted position and for engaging said locking lug (68') to prevent opening of said storage unit (14') when said plunger means (72') is in said extended position.

6. An apparatus as set forth in claim 4 wherein said actuator means (72'') includes a key element (212'', 218'') for manual rotation between a rotated and unrotated position, a cam (216'') operatively connected between said key element (212'', 218'') and said locking bar (62) for rotating in response to rotation of said key element (212'', 218'') to move said locking bar (62) to said lock position in response to said key element (212'', 218'') rotating to said unrotated position and to move said locking bar (62'') to said unlock position in response to said key element (212'', 218'') rotating to said rotated position.

7. An apparatus as set forth in claim 1 wherein said input means (74) includes a keypad having a plurality of momentary depressible keys for input of said input code and said selection number.

8. An apparatus as set forth in claim 1 wherein said control means (72) includes reset button means (94) for producing a reset signal.

9. An apparatus as set forth in claim 8 wherein said processor means (110) includes reset access means for receiving said reset signal and a new access code from said input means (74) and for replacing said access code in said data memory means (124) with said new access code.

10. An apparatus as set forth in claim 1 wherein said control means (72) includes manually actuatable code switches for establishing a key code.

11. An apparatus as set forth in claim 10 wherein said processor means (110) includes key means for receiving said key code when said input code does not equal said access code stored in said data memory means (125) and producing said unlock signal when said input code equals said key code.

12. An apparatus as set forth in claim 1 wherein including audible indicator means responsive to said processor means for audibly indicating a correct sequence of input on said input means (174) and equivalence of said input code with said access code.

13. An apparatus as set forth in claim 12 further characterized by including visual indicator means responsive to said processor means (78) for visually indicating the authorization of said input code.

14. An apparatus as set forth in claim 13 wherein said control means (72) including external power means and battery power means, power monitoring means for sensing the level of power of said external power means and switching to said battery power means when said level of power is below a predetermined voltage.

15. An apparatus as set forth in claim 16 wherein said manual locking means for manually locking said locking means (16) upon manual actuation thereof.

16. An apparatus as set forth in claim 1 wherein each control means including; transmission means coacting with the associated storage unit for rotating said control means between an unactuated position and an actuated position, and key means coacting between said housing means and said control means for limiting vertical movement of said control means to said neutral position during rotation thereof between said unactuated and actuated positions.

17. An apparatus as set forth in claim 16 further characterized by each control means including shifting means for vertically moving all other control means from their respective neutral positions to respective blocking positions in response to rotation of said control means from said unactuated position to said actuated position.

18. An apparatus as set forth in claim 16 wherein said link means movably supported by said housing means and responsive to said shifting means for vertically moving all of said control means in response to rotation of one of said control means from said unactuated storage unit.

19. An apparatus as set forth in claim 18 wherein each control means including lug means extending radially from blocking engagement with the associated storage unit when in said upper and lower blocking positions and for rotating with said control means to said actuated position.

20. An apparatus as set forth in claim 19 further characterized by said key means coacting with said lug means during rotation of said control means from said unactuated position to said actuated position for limiting said vertical movement of the associated control means during rotational movement thereof.

21. A file cabinet apparatus comprising:

housing means (12) defining an enclosure;

a plurality of drawer units (14) to be slideably supported by said housing means (12) for sliding between a closed position and an open position;

blocking means (28) disposed along a side of said drawer units (14) for preventing opening movement from said closed position of all but one of said storage units (14) in response to opening of said one of said storage units (14);

locking means (60) independent from said blocking means (28) and disposed along said plurality of drawer units (14) having a locking condition for locking each of said storage units (14) in said closed position and an unlocked condition responsive to an unlocking signal for unlocking and allowing said storage units (14) to move to said open position limited by said blocking means (28), and electronic control circuit responsive to manual activation for receiving sand validating an electronic input code to produce said unlock signal for unlocking said locking means (60) allowing opening of only one of said storage units (14) limited by said blocking means (28) and for locking said locking means (60) preventing opening of all storage units (14) in the absence of said unlock signal.

* * * * *